United States Patent [19]

Tack et al.

[11] Patent Number: 4,882,034

[45] Date of Patent: Nov. 21, 1989

[54] CRUDE OIL OR FUEL OIL COMPOSITIONS

[75] Inventors: Robert D. Tack, Oxford; Kenneth Lewtas, Wantage, both of United Kingdom

[73] Assignee: Exxon Chemical Patents Inc., Linden, N.J.

[21] Appl. No.: 166,874

[22] Filed: Mar. 11, 1988

[30] Foreign Application Priority Data

Mar. 18, 1987 [GB] United Kingdom ..... 8706369

[51] Int. Cl.[4] ..... C10L 1/22

[52] U.S. Cl. ..... 208/15; 208/14; 44/72; 585/6.6; 585/10; 585/13; 585/14

[58] Field of Search ..... 208/14, 15; 585/6.6, 585/12, 13, 14, 10; 44/64, 72, 74, 62; 525/327.7

[56] References Cited

U.S. PATENT DOCUMENTS

| | | | |
|---|---|---|---|
| Re. 30,238 | 3/1980 | Specht et al. | 44/62 |
| 2,892,690 | 6/1959 | Lowe et al. | 44/62 |
| 3,776,247 | 12/1973 | Choufoer | 585/12 |
| 3,790,358 | 2/1974 | Rossi et al. | 44/62 |
| 3,832,150 | 8/1974 | Feldman | 44/62 |
| 3,926,579 | 12/1975 | Rossi et al. | 585/12 |
| 3,956,149 | 5/1976 | Coleman | 252/51.5 |
| 3,961,916 | 6/1976 | Ilnyckyj et al. | 44/62 |
| 3,982,909 | 9/1976 | Hollyday | 44/66 |
| 4,010,006 | 3/1977 | Price | 585/12 |
| 4,147,520 | 4/1979 | Ilnyckyj | 44/62 |
| 4,210,424 | 7/1980 | Feldman et al. | 44/70 |
| 4,211,534 | 7/1980 | Feldman | 44/62 |
| 4,312,965 | 1/1982 | Tachimowicz | 525/374 |
| 4,375,973 | 3/1983 | Rossi et al. | 44/70 |
| 4,464,182 | 8/1984 | Tack et al. | 44/62 |
| 4,546,137 | 10/1985 | Rossi et al. | 252/54 |
| 4,569,679 | 2/1986 | Rossi | 44/70 |
| 4,589,990 | 5/1986 | Zehler et al. | 585/12 |
| 4,734,204 | 3/1988 | Lamb | 525/327.7 |

FOREIGN PATENT DOCUMENTS

| | | | |
|---|---|---|---|
| 0061895 | 10/1982 | European Pat. Off. | 44/62 |
| 0087234 | 8/1983 | European Pat. Off. | 252/51.5 |
| 0172758 | 2/1986 | European Pat. Off. | 44/62 |
| 0204587 | 12/1986 | European Pat. Off. | 258/18 |
| 802589 | 10/1958 | United Kingdom | 208/46 |
| 1318947 | 5/1973 | United Kingdom | 208/46 |
| 1511503 | 5/1978 | United Kingdom | 252/51.5 |

OTHER PUBLICATIONS

Journal of Institute of Petroleum, vol. 52, No. 510, Jun. 1966, pp. 173–185.

*Primary Examiner*—Anthony McFarlane

*Attorney, Agent, or Firm*—R. A. Maggio; V. T. White

[57] ABSTRACT

As a flow improver in a crude oil or a liquid hydrocarbon fuel are used polymers containing more than one amide group, the amide being an amide of a secondary amine, and either the amide group or an ester group of the polymer containing a hydrogen- and carbon-containing group of at least 10 carbon atoms, provided that if the polymer is derived from the polymerization of an aliphatic olefin and maleic anhydride, the polymer must have both an amide group and an ester group each of which contains a hydrogen- and carbon-containing group of at least 10 carbon atoms, for example, a diamide of a copolymer of an alkyl fumarate, vinyl acetate and maleic anhydride.

25 Claims, No Drawings

CRUDE OIL OR FUEL OIL COMPOSITIONS

This invention relates to crude oil and fuel oil compositions containing a flow improver.

Wax separation in crude oils, middle distillate fuels, heavy and residual fuels and lubricating oils limits their flow at low temperatures. The usual method of overcoming these problems is to add wax crystal modifying compounds that cause the wax crystals to be smaller (nucleators) and/or to be smaller and to grow into more compact shapes (growth inhibitors).

Another difficulty is that small wax crystals can stick together and form larger agglomerates and these agglomerates as well as the individual crystals can block the filter screens through which the individual crystals would pass and they will settle more rapidly than do the individual, small crystals.

We have now found that the wax crystals may be modified so as to improve filterability and reduce the pour point and the tendency of the wax crystals to agglomerate may be reduced by the addition of certain amides.

According to this invention a crude oil or a fuel oil composition comprises a major proportion by weight of a crude oil or a liquid hydrocarbon fuel and a minor proportion by weight of a polymer containing more than one amide group, the amide being an amide of a secondary amine and wherein either the amide group or an ester group of the polymer contains a hydrogen- and carbon-containing group of at least 10 carbon atoms; provided that if the polymer is derived from the polymerisation of an aliphatic olefin and maleic anhydride, the polymer must have both an amide group and an ester group each of which contains a hydrogen- and carbon-containing group of at least 10 carbon atoms. It is to be understood that the proviso only applies to an aliphatic olefin, e.g. a mono-olefin, containing only carbon and hydrogen atoms, i.e. it does not apply to olefinically unsaturated compounds containing other atoms or groups, e.g. unsaturated esters.

Also according to this invention, there is the use as a flow improver in a crude oil or a liquid hydrocarbon fuel oil of polymers containing more than one amide group, the amide being an amide of a secondary amine, and either the amide group or an ester group of the polymer containing a hydrogen- and carbon-containing group of at least 10 carbon atoms, provided that if the polymer is derived from the polymerisation of an aliphatic olefin and maleic anhydride, the polymer must have both an amide group and an ester group each of which contains a hydrogen- and carbon-containing group of at least 10 carbon atoms.

Although the polymers may be used as flow improvers in crude oils, i.e. oils as obtained from drilling and before refining, they are preferably used as flow improvers in liquid hydrocarbon fuels. The liquid hydrocarbon fuel oils can be the middle distillate fuel oils, e.g. a diesel fuel, aviation fuel, kerosene, fuel oil, jet fuel, heating oil etc. Generally, suitable distillate fuels are those boiling in the range of 120° to 500° C. (ASTM D86), preferably those boiling in the range of 150° to 400° C. A representative heating oil specification calls for a 10 percent distillation point no higher than about 226° C., a 50 percent point no higher than about 272° C. and a 90 percent point of at least 282° C. and no higher than about 338° C. to 343° C., although some specifications set the 90 percent point as high as 357° C. Heating oils are preferably made of a blend of virgin distillate, e.g. gas oil, naphtha, etc. and cracked distillates, e.g. catalytic cycle stock.

The polymer containing more than one amide group can be prepared in different ways. One way is to use a polymer having a plurality of carboxylic acid or anhydride groups and to react this polymer with a secondary amine to obtain the desired polymer containing amide groups.

Another way is to polymerise a monomer containing the desired amide group. If desired such monomers can be co-polymerised with other monomers not necessarily having amide groups.

If the polymers obtained by these methods do not contain hydrogen- and carbon-containing groups of at least 10 carbon atoms in the amide group, then these polymers must have an ester group containing a hydrogen- and carbon-containing group of at least 10 carbon atoms.

Of course, if the polymer is derived from the polymerisation of an aliphatic olefin and maleic anhydride the polymer must also have an ester group containing a hydrogen- and carbon-containing group of at least 10 carbon atoms attached thereto.

There are many different types of polymer which can be further reacted to produce the desired polymer containing two or more amide groups.

(I) Examples are polymers of one or more unsaturated monomers also including ester and free acid groups and copolymers of unsaturated ester monomers at least one of which monomers has a free acid group. Specific examples are copolymers of a dialkyl fumarate, maleate, citraconate or itaconate with a monoalkyl fumarate, maleate, citraconate or itaconate, copolymers of vinyl acetate with a monoalkyl fumarate, maleate, citraconate or itaconate, copolymers of an alkyl acrylate or an alkyl methacrylate with a mono alkyl fumarate, maleate citraconate or itaconate and copolymers of a dialkyl fumarate, maleate, citraconate or itaconate with a monoalkyl fumarate, maleate, citraconate or itaconate and with vinyl acetate.

Particularly suitable examples of type I polymers are a copolymer of vinyl acetate, a dialkyl fumarate and a monoalkyl fumerate where the alkyl groups are 1:1 mixtures of dodecyl and tetradecyl; and copolymers of vinyl acetate and either monodecyl, monotetradecyl or monohexadecyl fumarate.

II. Other examples are copolymers of an unsaturated carboxylic anhydride with an olefin. These copolymers on reaction with a secondary amine can give half amide/half amine salts due to reaction with the anhydride grouop. On heating water can be removed to form the diamide. Specific examples are copolymers of maleic anhydride with styrene or with an aliphatic olefin, for example a $C_{10}$ to $C_{30}$ olefin such as decene, dodecene, tetradecene, hexadecene, eicosene, docosene, tetracosene, octacosene, propylene tetramer, or propylene hexamer.

III. Other examples are copolymers of an unsaturated ester (and optionally an olefin) with an unsaturated carboxylic anhydride. These copolymers on reaction with a secondary amine will give half amide/half amine salts due to reaction with the anhydride group. On heating water can be removed to form the diamide. Specific examples are copolymers (a) of a dialkyl fumarate, maleate, citraconate or itaconate with maleic anhydride, or (b) of vinyl esters e.g. vinyl acetate or vinyl stearate, with maleic anhydride or (c) of a dialkyl fumarate, maleate, citraconate or itaconate with maleic anhydride and vinyl acetate.

Particularly suitable examples of Type III polymers are copolymers of didodecyl fumarate, vinyl acetate and maleic anhydride; di-tetradecyl fumarate, vinyl acetate and maleic anhydride; di-hexadecyl fumarate, vinyl acetate and maleic anhydride; or the equivalent copolymers where instead of the fumarate the itaconate is used.

IV. Suitable polymers are also polymers of unsaturated carboxylic acids, for example polyacrylic acid or polymethacrylic acid; copolymers of acrylic acid with an olefin, e.g. ethylene or an alkyl fumarate and copolymers of methacrylic acid with an olefin, e.g. ethylene or an alkyl fumarate.

V. The desired polymers may alternatively be prepared by partial hydrolysis of a polymer containing ester groups to obtain carboxylic acid or anhydride groups. Thereafter the partially hydrolysed polymer is reacted with a secondary amine to produce the desired polymer containing two or more amide groups. Thus, one may partially hydrolyse polymers of acrylates, methacrylates, alkyl fumarates, alkyl maleates, alkyl citraconates, alkyl itaconates or copolymers thereof with an olefin.

Particularly suitable examples of Type V polymers are partially hydrolysed polymers of dodecyl acrylate, tetradecyl acrylate or hexadecyl acrylate.

In all the above-mentioned types of suitable polymer (I, II, III, IV and V) the desired amide is obtained by reacting the polymer containing carboxylic acid or anhydride groups with a secondary amine (optionally also with an alcohol whence an ester-amide is formed). Very often, for example when reacting polymers containing an anhydride group, the resulting amino groups will be ammonium salts and amides. Such polymers can be used, provided that they contain at least two amide groups.

VI Other suitable polymers are obtained by partial hydrolysis of polymers of unsaturated esters followed by reaction with a carboxylic anhydride which is thereafter reacted with a secondary amine to form the desired amide. Suitable polymers of unsaturated esters are homo polymers of acrylates, methacrylates, alkyl fumarates, or copolymers thereof with an olefin, for example, ethylene or a copolymer of vinyl acetate with an olefin. A specific example is an ethylene-vinyl acetate copolymer. After partial hydrolysis the polymer is reacted with an acid anhydride, e.g. succinic or maleic anhydride and the resulting product can be reacted with a secondary amine to obtain the corresponding amide.

Polymers derived from monomers already containing amide groups where the amide is an amide of a secondary amine include (A) N,N,N'N' tetra hydrocarbyl-fumaradiamide polymers or N,N,N',N' tetra hydrocarbyl-maleadiamide polymers. Such polymers can be homopolymers provided at least one of the hydrocarbyl groups contains at least 10 carbon atoms or they can be copolymers with unsaturated monomers, for example, vinyl acetate; a dialkyl fumarate, maleate, citraconate or itaconate; an olefin; or a mixture of unsaturated monomers, for example, a dialkyl fumarate and vinyl acetate.

(B) Other examples include polymers of N,N-dihydrocarbyl acrylamide or N,N dihydrocarbyl methacrylamide.

These polymers may be homopolymers or copolymers with unsaturated monomers, for example, an alkyl acrylate; an alkyl methacrylate, an olefin, a dialkyl fumarate, maleate, citraconate or itaconate or a mixture of such unsaturated monomers.

It is essential that the polymer containing at least two amide groups contains at least one hydrogen- and carbon-containing group of at least 10 carbon atoms. This long chain group which is preferably a straight chain or branched alkyl group can be present either attached directly or through a carboxylate group to the backbone of the polymer or attached to the nitrogen atom of the amide group. Thus in type I, III, V, A and B polymers the alkyl groups of the mono- and di-alkyl fumarate, maleate, citraconate or itaconate, of the alkyl acrylate or of the alkyl methacrylate from which the polymers are derived can contain at least 10 carbon atoms. Particularly suitable monomers are therefore didodecyl fumarate, ditetradecyl fumarate, di octadecyl fumarate and the corresponding mono alkyl fumarates and mixtures thereof. Also dodecyl, tetradecyl, hexadecyl and octadecyl acrylates and methacrylates are particularly suitable. In type V polymers one could use for example di-decyl, didodecyl, di-tetradecyl maleates, citraconates or itaconates.

As an alternative or in addition one can introduce the long chain group into the polymer by using a long chain sec-amine in forming the amide. Of course, if the polymer is derived from the polymerisation of an olefin and maleic anhydride the polymer must have both an ester and an amide group containing the long chain group.

The secondary amines can be represented by the formula $R^1R^2NH$ and the polyamines $R^1NH[R^3NH]_xR^4$ wherein $R^1$ and $R^2$ are hydrocarbyl groups, preferably alkyl groups, $R^4$ is hydrogen or a hydrocarbyl group, $R^3$ is a divalent hydrocarbyl group, preferably an alkylene or hydrocarbyl substituted alkylene group and x is an integer. Preferably either or both of $R^1$ and $R^2$ contain at least 10 carbon atoms, for instance 10 to 20 carbon atoms, for example dodecyl, tetradecyl, hexadecyl or octadecyl.

Examples of suitable secondary amines are dioctyl amine and those containing alkyl groups with at least 10 carbon atoms, for instance didecylamine, didodecylamine, di-coco amine (i.e. mixed $C_{12}$ to $C_{14}$ alkyl amines), dioctadecyl amine, hexadecyl, octadecyl amine, dihydrogenated tallow amine (approximately 4 wt % n $C_{14}$ alkyl, 30 wt % n $C_{10}$ alkyl, 60 wt % n $C_{18}$ alkyl, the remainder being unsaturated) (Armeen 2HT) n-cocopropyl diamine ($C_{12}/C_{14}$ alkyl-propyl diamine-Duomeen C) n-tallow-propyl diamine ($C_{16}/C_{18}$ alkyl, propyl diamine-Duomeen T).

Examples of suitable polyamines are N-octadecyl propane diamine, N,N' di-octadecyl propane diamine, N-tetradecyl butane diamine and N,N' di hexadecyl hexane diamine.

The polymers produced by reacting a carboxylic acid or anhydride group with a secondary amine may contain amine salt groups, i.e. they may be half amides, half salts, but they are suitable as long as they do contain the defined amide groups. Usually the half amide, half salt can be converted to the di-amide if desired, by heating whence water is removed.

The amide-containing polymers usually have a number average molecular weight of 1,000 to 500,000, for example 10,000 to 100,000.

Particularly suitable examples of amide group containing polymers for use in the present invention are:

(1) The half-amine salt, half amide of di $C_{16}/C_{18}$ alkyl amine ($C_{16}$ alkyl:$C_{18}$ alkyl being approximately 1:2) reacted with a copolymer of di-tetradecyl fumarate, vinyl acetate and maleic anhydride, the amount of maleic anhydride being 10 wt % in the copolymer.

(2) As (1) above but the diamide.

(3) As (1) but the diamine being $R_2NH$ (Armeen C) where R is 0.5 wt % $C_6$ alkyl, 8 wt % $C_8$ alkyl, 7 wt % $C_{10}$ alkyl, 50 wt % $C_{12}$ alkyl, 18 wt % $C_{14}$ alkyl, 8 wt % $C_{10}$ alkyl, 1.5 wt % $C_{18}$ alkyl and 7.0 wt % $C_{18}/C_{19}$ unsaturated.

(4) As (3) but the diamide.

(5) As (1) but the diamine being n-tallow ($C_{16}/C_{18}$alkyl) propyl diamine.

(6) As (5) but the diamide.

(7) As (1) but only 5 mole % maleic anhydride in the copolymer.

(8) As (7) but the diamide.

(9) As (3) but only 5 mole % maleic anhydride in the copolymer.

(10) As (9) but the diamide.

(11) A styrene-maleic anhydride copolymer reacted with the diamine $R_2NH$ where R is a n $C_{16}$ alkyl/n $C_{18}$ alkyl mixture.

(12) A styrene-maleic anhydride copolymer reacted with a mixture of 90 wt % tetradecanol and 10 wt % of the diamine $R_2NH$ where R is a n $C_{16}$ alkyl/n $C_{18}$ alkyl mixture.

Improved results are often achieved when the fuel compositions of this invention incorporate other additives known for improving the cold flow properties of distillate fuels generally. Examples of these other additives are the polyoxyalkylene esters, ethers, ester/ethers amide/esters and mixtures thereof, particularly those containing at least one, preferably at least two $C_{10}$ to $C_{30}$ linear saturated alkyl groups of a polyoxyalkylene glycol of molecular weight 100 to 5,000 preferably 200 to 5,000, the alkyl group in said polyoxyalkylene glycol containing from 1 to 4 carbon atoms. European patent publication No. 0,061,895 A2 describes some of these additives.

The preferred esters, ethers or ester/ethers may be structurally depicted by the formula:

$$R^5—O—(A)—O—R^6$$

where $R^5$ and $R^6$ are the same or different and may be (i) n-alkyl (ii)

$$\text{n-alkyl}—\overset{\overset{\displaystyle O}{\|}}{C}—$$

(iii)

$$\text{n-alkyl}—O—\overset{\overset{\displaystyle O}{\|}}{C}—(CH_2)_n—$$

(iv)

$$\text{n-alkyl}—O—\overset{\overset{\displaystyle O}{\|}}{C}(CH_2)_n—\overset{\overset{\displaystyle O}{\|}}{C}—$$

the alkyl group being linear and saturated and containing 10 to 30 carbon atoms, and A represents the polyoxyalkylene segment of the glycol in which the alkylene group has 1 to 4 carbon atoms, such as polyoxymethylene, polyoxyethylene or polyoxytrimethylene moiety which is substantially linear; some degree of branching with lower alkyl side chains (such as in polyoxypropylene glycol) may be tolerated but it is preferred the glycol should be substantially linear.

Suitable glycols generally are the substantially linear polyethylene glycols (PEG) and polypropylene glycols (PPG) having a molecular weight of about 100 to 5,000, preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids. The esters may also be prepared by esterifying polyethoxylated fatty acids or polyethoxylated alcohols. A particularly preferred additive of this type is polyethylene glycol dibehenate, the glycol portion having a molecular weight of about 600 and is often abbreviated as PEG 600 dibehenate.

Other suitable additives for fuel composition of this invention are ethylene unsaturated ester copolymer flow improvers. The unsaturated monomers which may be copolymerised with ethylene include unsaturated mono and diesters of the general formula:

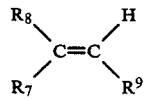

wherein $R_8$ is hydrogen or methyl, $R_7$ is a $—OOCR_{10}$ group wherein $R_{10}$ is hydrogen or a $C_1$ to $C_{28}$, more usually $C_1$ to $C_{17}$, and preferably a $C_1$ to $C_8$, straight or branched chain alkyl group; or $R_7$ is a $—COOR_{10}$ group wherein $R_{10}$ is as previously defined but is not hydrogen and $R_9$ is hydrogen or $—COOR_{10}$ as previously defined. The monomer, when $R_7$ and $R_9$ are hydrogen and $R_8$ is $—OOCR_{10}$, includes vinyl alcohol esters of $C_1$ to $C_{29}$, more usually $C_1$ to $C_{18}$, monocarboxylic acid, and preferably $C_2$ to $C_{29}$, more usually $C_1$ to $C_{18}$, monocarboxylic acid, and preferably $C_2$ to $C_5$ monocarboxylic acid. Examples of vinyl esters which may be copolymerised with ethylene include vinyl acetate, vinyl propionate and vinyl butyrate or isobutyrate, vinyl acetate being preferred. It is preferred that the copolymers contain from 20 to 40 wt % of the vinyl ester, more preferably from 25 to 35 wt % vinyl ester. They may also be mixtures of two copolymers such as those described in U.S. Pat. No. 3,961,916. It is preferred that these copolymers have a number average molecular weight as measured by vapour phase osmometry of 1,000 to 6,000, preferably 1,000 to 3,000.

Other suitable additives for fuel compositions of the present invention are polar compounds, either ionic or non-ionic, which have the capability in fuels of acting as wax crystal growth inhibitors. Polar nitrogen containing compounds have been found to be especially effective when used in combination with the glycol esters, ethers or ester/ethers. These polar compounds are generally amine salts and/or amides formed by reaction of at least one molar proportion of hydrocarbyl substituted amines with a molar proportion of hydrocarbyl acid having 1 to 4 carboxylic acid groups or their anhydrides; ester/amides may also be used containing 30 to 300, preferably 50 to 150 total carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$, preferably $C_{14}$ to $C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctadecyl amine, methylbehenyl amine and the like. Amine mixtures are also suitable and many amines derived from natural materials are mixtures. The preferred amine is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclo-hexane, 1,2 dicarboxylic acid, cyclohexane dicarboxylic acid, cyclopentane 1,2 dicarboxylic acid, naphthalene dicarboxylic acid and the like. Generally, these acids will have about 5–13 carbon atoms in the cyclic moiety. Preferred acids are benzene dicarboxylic acids such as phthalic acid, terephthalic acid, and isophthalic acid. Phthalic acid or its anhydride is particularly preferred. The particularly preferred compound is the amide-amine salt formed by reacting 1 molar portion of phthalic anhydride with 2 molar portions of di-hydrogenated tallow amine. Another preferred compound is the diamide formed by dehydrating this amide-amine salt.

The relative proportions of additives used in the mixtures are preferably from 0.05 to 20 parts by weight, more preferably from 0.1 to 5 parts by weight of the amide-containing polymer to 1 part of the other additives such as the polyoxyalkylene esters, ether or ester/ether or amide-ester.

The amount of amide-containing polymer added to the crude oil or liquid hydrocarbon fuel is preferably 0.0001 to 5.0 wt %, for example, 0.001 to 0.5 wt % especially 0.01 to 0.05 wt % (active matter) based on the weight of the crude oil or liquid hydrocarbon fuel oil.

The polymer may conveniently be dissolved in a suitable solvent to form a concentrate of from 20 to 90, e.g. 30 to 80 wt % of the polymer in the solvent. Suitable solvents include kerosene, aromatic naphthas, mineral lubricating oils etc.

EXAMPLE 1

In this Example various half amide, half amine salt- and diamide-containing/polymers based on alkyl fumarate-vinyl acetate-maleic anhydride copolymers mixed with the polyethylene glycol dibehenate, the glycol portion having a MW of about 600 (PEG 600 dibehenate) were added to a distillate fuel oil F1 having the characteristics given below.

| Wax Content %[a] | WAT (°C.)[b] | WAP (°C.) | ASTM D 86 Distillation IBP | D20 | D50 | D90 | FBP |
|---|---|---|---|---|---|---|---|
| 4.9/9.8[c] | 10.3 | 7.5 | 204 | 262 | 295 | 346 | 362 |

[a]Wax at 5° C. below WAT/10° C. below WAT.
[b]Corrected for thermal lag.
[c]Estimated from component values.

The various polymers blended in each case with PEG 600 dibehenate in a weight ratio of 4 parts of polymer per part of PEG 600 dibehenate were as follows:

| Amide-containing Polymer | Details |
|---|---|
| A | Half amide, half amine salt of di tetradecyl fumarate- vinyl acetate- 10 mole % maleic anhydride copolymer, the amine being $R_2NH$ where is as given previously for Armeen C. |
| B | Half amide, half amine salt of di-tetra decyl fumarate - vinyl acetate - 10 mole % maleic anhydride, the amine being n-tallow propyl diamine. |
| C | A copolymer of 50 mole % vinyl acetate, 45 mole % di-tetradecyl fumarate and 5 mole % maleic anhydride reacted in a mole ratio of 1:1 with $R_2NH$ where R = $C_{16}/C_{18}$ alkyl to produce the half amide-half amine salt. |
| D | Half amide, half amine salt of di tetradecyl fumarate - vinyl acetate - 5 mole % maleic anhydride copolymer, the amine being $R_2NH$ where R = $C_{16}/C_{18}$ alkyl. |
| E | Half amide, half amine salt of di-tetradecyl fumarate - vinyl acetate - 5 mole % maleic anhydride copolymer, the amine being $R_2$—NH where R is as given previously for Armeen C. |
| F | The diamide of di-tetradecyl fumarate -vinyl acetate - 10 mole % maleic anhydride copolymer and $R_2NH$ where R is $C_{16}/C_{18}$ alkyl. |
| G | The diamide of di-tetradecyl fumarate -vinyl acetate - 10 mole % maleic anhydride copolymer and $R_2NH$ where R is as given previously for Armeen C. |
| H | The diamide of di-tetradecyl fumarate -vinyl acetate - 10 mole % maleic anhydride copolymer and n-tallow, propyl diamine. |
| I | The amide of di-tetradecyl fumarate - vinyl acetate - 5 mole % maleic anhydride copolymer and $R_2NH$ where R = $C_{16}/C_{18}$ alkyl |
| J | The amide of di-tetradecyl fumarate- vinyl acetate - 5 mole % maleic anhydride copolymer and $R_2NH$ where R is as given previously for Armeen C. |
| K | The diamide of di-tetradecyl fumarate- vinyl acetate- 5 mole % maleic anhydride copolymer and $R_2NH$ where R = $C_{16}/C_{18}$ alkyl. |
| L | The diamide of di-tetradecyl fumarate- vinyl acetate - 5 mole % maleic anhydride copolymer and $R_2NH$ where R is as given previously for Armeen C. |
| M | The half amide, half amine salt of di-tetradecyl fumarate- vinyl acetate - 5 mole % maleic anhydride copolymer, the amine being $R_2NH$ where R is as given previously for Armeen C. |

Polymers A and G blended in each case in a weight ratio of 4 parts of polymer per part of PEG 600 behenate were added to fuel oil F1 and the CFPPT and PCT determined. Details of the two tests are as follows:

PROGRAMMED COOLING TEST (PCT)

This is a slow cooling test designed to correlate with the pumping of a stored heating oil. The cold flow properties of the described fuels containing the additives are determined by the PCT as follows. 300 ml of fuel are cooled linearly at 1° C./hour to the test temperature and the temperature then held constant. After 2 hours at the test temperature, approximately 20 ml of the surface layer is removed by suction to prevent the test being influenced by the abnormally large wax crystals which tend to form on the oil/air interface during cooling. Wax which has settled in the bottle is dispersed by gentle stirring, then a CFPPT filter assembly is inserted. The tap is opened to apply a vacuum of 500 mm of mercury, and closed when 200 ml of fuel have passed through the filter into the graduated receiver: a PASS is recorded if the 200 ml are collected within ten seconds through a given mesh size or A fail if the flow rate is too slow indicating that the filter has become blocked.

The mesh number passed at the test temperature is recorded.

THE COLD FILTER PLUGGING POINT TEST (CFPPT)

The cold flow properties of the blend were determined by the Cold Filter Plugging Point Test (CFPPT). This test is carried out by the procedure described in detail in "Journal of the Institute of Petroleum", Vol. 52, No. 510, June 1966 pp. 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette to a mark indicating 20 ml of oil. The test is repeated with each one degree drop in temperature until the oil fails to fill the pipette within 60 seconds. The results of the test are quoted as Δ CFPPT (°C.) which is the difference between the fail temperature of the untreated fuel ($CFPP_o$) and the fuel treated with the flow improver ($CFPP_1$) i.e. $\Delta CFPP = CFPP_o - CFPP_1$.

Determinations by CFPPT were carried out on fuel oil F1 polymers A to M and X all blended with PEG 600 dibehenate in a weight ratio of 4:1 respectively. Copolymer X which is included for comparison purposes is a copolymer of vinyl acetate and ditetradecyl fumarate. The results are as follows:

| Polymer | Δ CFPP 1500 ppm (active ingredient) | Δ CFPP 3000 ppm (active ingredient) |
|---|---|---|
| A | 1 | 4.5 |
| B | 1.5 | 2.5 |
| C | −2* | 5.5 |
| D | 0.5 | 3.5 |
| E | 0.5 | 3 |
| F | −0.5* | 0 |
| G | 1.5 | 2 |
| H | 2 | 4 |
| I | 1.5 | 4 |
| J | 1 | 4 |
| K | 0.5 | 5 |
| L | 0.5 | 3 |
| M | 0.5 | 3 |
| X | 1.5 | 3.5 |

*Negative sign indicates an increase in CFPP

The PCT (+2° C.) was also carried out on fuel oil F1 containing polymers A, C, D, E, G, H, J, K, M and X all blended with PEG 600 dibehenate in a weight ratio of 4:1 respectively. The results obtained were as follows:

| Polymer | PCT Mesh passed @ 2° C.* 150 ppm ai | PCT Mesh passed @ 2° C.* 3000 ppm ai |
|---|---|---|
| A | 40 | 100 |
| C | 60 | 150 |
| D | 100 | 200 |
| E | 30 | 60 |
| G | 100 | 200 |
| H | 80 | 100 |
| J | 60 | 100 |
| K | 80 | 150 |
| M | 30 | 80 |
| X | 80 | 150 |
| No polymer (Base fuel alone) | <20 | |

*Test temperature.

The advantages of the blends containing the polymer over the base fuel alone can be clearly seen.

The PCT was also determined for various blends of polymer K with PEG 600 dibehenate (PEG) in fuel oil F1. The results obtained were as follows:

| Additive | PCT mesh passed at 2° C. 1500 ppm ai | PCT mesh passed at 2° C. 3000 ppm ai |
|---|---|---|
| K:PEG(4:1) | 100 | 200 |
| K:PEG(2:1) | 100 | 150 |
| K:PEG(1:1) | 100 | 150 |
| Fuel oil alone | <20 | |

EXAMPLE 2

In this Example the amide-containing polymers C, D, E, I, J, K, L and M used in Example 1 were added to a high boiling point distillate fuel F2 and the CFPP (F2 alone) and the Δ CFPP measured in each case. The ASTM D86 distillation details of F2 are as follows:

| | |
|---|---|
| IBP | 172° C. |
| D20 | 228° C. |
| D50 | 276° C. |
| D90 | 362° C. |
| FBP | 389° C. |

The results are given below for each polymer added at 300 ppm and 500 ppm (active ingredient), i.e. 0.03 wt % and 0.05 wt %, to the base fuel oil, F2 and when compared with the untreated fuel oil.

| Amide-Containing Polymer ppm | Concentration CFPP | Δ CFPP | | |
|---|---|---|---|---|
| C | 300 | −3 | −3 | 8 |
| C | 500 | −6 | −5 | 9 |
| D | 300 | −5 | −2 | 10 |
| D | 500 | −6 | −6 | 7 |
| E | 300 | +1 | +2 | 2 |
| E | 500 | −8 | −5 | 10 |
| I | 300 | −1 | −4 | 6 |
| I | 500 | −3 | −3 | 7 |
| J | 300 | +3 | −0 | 3 |
| J | 500 | −4 | −5 | 8 |
| K | 300 | −4 | −3 | 7 |
| K | 500 | −5 | −5 | 9 |
| L | 300 | −3 | −3 | 6 |
| L | 500 | −6 | −6 | 10 |
| M | 300 | +3 | +4 | 0 |
| M | 500 | −4 | −5 | 8 |
| Base fuel Oil alone | | +4 | +3 | |

It can be seen that in all cases there is considerable reduction in the flow point when the amide-containing polymers are added to the base fuel oil.

The amide-containing polymers C, D, E, I, J, K L and M were also blended with a copolymer Y in a mole ratio of 1:4 respectively and then added to F2 at concentrations of 300 and 500 ppm (0.03 wt % and 0.05 wt %). Copolymer Y is a 3:1 weight mixture of an ethylene/vinyl acetate copolymer containing 36 wt % vinyl acetate of molecular weight about 2000 and an ethylene/vinyl acetate copolymer containing 13 wt % vinyl acetate of molecular weight about 3000.

As before the CFPP (treated fuel oil) and the Δ CFPP were measured in each case. The results are as follows:

| Amide-Containing Polymer | Concentration Y (ppm) | Concentration Polymer (ppm) | CFPP | | Δ CFPP |
|---|---|---|---|---|---|
| C | 240 | 60 | −14 | −12 | 17 |
| C | 400 | 100 | −17 | −16 | 20 |
| D | 240 | 60 | −15 | −14 | 18 |
| D | 400 | 100 | −14 | −14 | 18 |
| E | 240 | 60 | −12 | −13 | 16 |
| E | 400 | 100 | −16 | −14 | 19 |
| I | 240 | 60 | −13 | −14 | 19 |
| I | 400 | 100 | −15 | −15 | 19 |
| J | 240 | 60 | −14 | −16 | 19 |
| J | 400 | 100 | −16 | −14 | 19 |
| K | 240 | 60 | −16 | −14 | 19 |
| K | 400 | 100 | −15 | −14 | 18 |
| L | 240 | 60 | −13 | −13 | 17 |
| L | 400 | 100 | −15 | −15 | 19 |
| M | 240 | 60 | −14 | −13 | 17 |
| M | 400 | 100 | −15 | −14 | 18 |
| Base fuel oil alone | | | +4 | +3 | |

It can be seen that in all cases there is considerable reduction in the flow point when the amide-containing polymers are added to the base fuel oil.

EXAMPLE 3

Various polymers either alone or in admixture with Polymer Y (see Example 2) were added to a distillate fuel oil F3 which had the following ASTM D86 distillation characteristics:

| | |
|---|---|
| IBP | 188° C. |
| D20 | 236° C. |
| D50 | 278° C. |
| D90 | 348° C. |
| FBP | 376° C. |

The results of the CFPPT and the PCT were as follows:

| Polymer | Conc (PPM) | CFPP | Δ CFPP | PCT @ −9° C. |
|---|---|---|---|---|
| C | 375 | −3, −3 | 3 | 40 |
| C | 625 | −4, −4 | 4 | 80 |
| D | 375 | −3, −3 | 3 | 40 |
| D | 625 | −4, −4 | 4 | 60 |
| E | 375 | −3, −4 | 3 | 40 |
| E | 625 | −5, −5 | 5 | 60 |
| I | 375 | −4, −4 | 4 | 40 |
| I | 625 | −3, −4 | 3 | 100 |
| J | 375 | −5, −4 | 4 | 60 |
| J | 625 | −4, −5 | 4 | 100 |
| K | 375 | −3, −3 | 3 | 40 |
| K | 625 | −5, −4 | 4 | 100 |
| L | 375 | −3, −3 | 3 | 40 |

-continued

| | | | | |
|---|---|---|---|---|
| L | 625 | −4, −5 | 4 | 80 |
| M | 375 | −5, −5 | 5 | 40 |
| M | 625 | −5, −4 | 4 | 60 |

| Concentration ppm Y | Polymer | CFPP | CFPP | PCT @ −9° C. |
|---|---|---|---|---|
| 300 | 75 C | −16, −18 | 17 | 150 |
| 500 | 125 C | −16, −18 | 17 | 200 |
| 300 | 75 D | −14, −15 | 14 | 120 |
| 500 | 125 D | −14, −15 | 14 | 200 |
| 300 | 75 E | −17, −14 | 15 | 150 |
| 500 | 125 E | −16, −19 | 17 | 200 |
| 300 | 75 I | −15, −16 | 15 | 200 |
| 500 | 125 I | −16, −17 | 16 | 200 |
| 300 | 75 J | −16, −15 | 15 | 200 |
| 500 | 125 J | −15, −17 | 16 | 200 |
| 300 | 75 K | −15, −16 | 15 | 120 |
| 500 | 125 K | −15, −16 | 15 | 150 |
| 300 | 75 L | −19, −18 | 18 | 150 |
| 500 | 125 L | −17, −18 | 17 | 200 |
| 300 | 75 M | −14, −16 | 15 | 150 |
| 500 | 125 M | −17, −16 | 16 | 200 |

EXAMPLE 4

In this Example another amide-containing polymer N was added to a distillate fuel F4 having the ASTM D86 distillation properties

| | |
|---|---|
| IBP | 173° C. |
| D20 | 222° C. |
| D50 | 297° C. |
| D90 | 356° C. |
| FBP | 371° C. |

Polymer N is the half amide, half amine salt of the copolymer of di-tetradecyl fumarate-vinyl acetate-10 mole % maleic anhydride, the amine being $R_2NH$ where R is $C_{16}/C_{18}$ alkyl.

This Polymer N was also blended in a 1:1 mole ratio with ethylene-vinyl acetate copolymer mixture Y. (See Example 2).

The polymer and mixture thereof in a mole ratio of 1:1 with Y were added to the fuel oil F4 at concentrations of 300 and 600 ppm (active ingredient) (0.03 and 0.06 wt %) and the resultant blends were subjected to the PCT and the CFPPT. The results are as follows:

| Amide-Containing Polymer | Poly-mer | Concentration (ppm) | PCT @ −8° C. | CFPP | |
|---|---|---|---|---|---|
| N | | 300 | 40 | +3 | +3 |
| N | | 600 | 80 | +2 | +3 |
| N | Y | 300 | 40 | −5 | −8 |
| N | Y | 600 | 80 | −9 | −8 |

EXAMPLE 5

In this Example amide-containing polymers A, B, F, G and H (as used in Example 1) and N (as used in Example 4) were added to the distillate fuel oil F4 of Example 4. Each polymer was blended in a 1:1 mole ratio with the copolymer mixture Y as used in Example 2.

Each polymer blended with copolymer mixture Y was added to the fuel oil F4 at two different concentrations, i.e. 300 and 600 ppm (0.03 wt % and 0.05 wt %) active ingredient and submitted to the PCT and CFPPT. The results obtained were as follows:

| Additive +Y (1:1) | Concentration (ppm) | PCT | −8° C. | CFPP | |
|---|---|---|---|---|---|
| N | 300 | 40 | 60 | | |
| N | 600 | 100 | 120 | +2 | +1 |
| N | 300 | 60 | 80 | | |
| N | 600 | 80 | 100 | −7 | −8 |
| F | 300 | 40 | 60 | | |
| F | 600 | 40 | 60 | +3 | +3 |
| F | 300 | 40 | 60 | | |
| F | 600 | 80 | 100 | −5 | −6 |
| A | 300 | 20 | 30 | | |
| A | 600 | 20 | 30 | +2 | +1 |
| A | 300 | 40 | 60 | | |
| A | 600 | 60 | 80 | −9 | −11 |
| G | 300 | 20 | 30 | | |
| G | 600 | 20 | 30 | +2 | +1 |
| G | 300 | 40 | 60 | | |
| G | 600 | 80 | 120 | −7 | −9 |
| B | 300 | — | 20 | | |
| B | 600 | — | 20 | +2 | +1 |
| B | 300 | 40 | 60 | | |
| B | 600 | 60 | 80 | −9 | −9 |
| H | 300 | — | 20 | | |
| H | 600 | — | 20 | +2 | +1 |
| H | 300 | 40 | 60 | | |
| H | 600 | 80 | 100 | −9 | −10 |
| Base fuel oil | | 20 | 30 | +3 | +3 |

It can be seen that in general adding the amide-containing polymer improves the flow properties of the base fuel oil.

EXAMPLE 6

Some styrene-maleic anhydride copolymers reacted with an amine and an alcohol/amine mixture were added to a distillate fuel oil F5 having the following ASTM D86 characteristics:

| | |
|---|---|
| IBP | 188° C. |
| D20 | 236° C. |
| D50 | 278° C. |
| D90 | 348° C. |
| FBP | 376° C. |

For comparison purposes some prior art flow improvers were also added to the same distillate fuel oil. From the Δ CFPP obtained in the CFPPT it can be seen that mixtures of copolymers containing styrene-maleic anhydride copolymers treated with an amine or alcohol/amine mixture show better results than those achieved with other flow improvers.

Copolymer P is a styrene/maleic anhydride copolymer treated with the diamine $R_2NH$ where R is a n $C_{16}$ alkyl/n $C_{18}$ alkyl mixture.

Copolymer Q is a styrene/maleic anhydride copolymer treated with the diamine $R_2NH$ where R is a n $C_{12}$ alkyl/n $C_{14}$ alkyl mixture.

Copolymer R is a styrene/maleic anhydride copolymer reacted with a mixture of 90 wt % tetradecanol ($C_{14}$) and 10 wt % of the diamine $R_2NH$ where R is a n $C_{16}$ alkyl/n $C_{18}$ alkyl mixture.

Prior art copolymers X and Y were as described in Examples 1 and 2 respectively and copolymer Z is a styrene/maleic anhydride copolymer reacted with tetradecanol.

In the following table the mixtures of copolymers were in a 1:1 mole ratio:

| Copolymer(s) 500 ppm | CFPP (°C.) |
|---|---|
| Y | 13 |
| X and Y | 14 |
| Y and Z | 16 |
| P and Y | 19 |
| Q and Y | 18 |
| R and Y | 17 |
| Fuel alone | 0 (CFPP) |

EXAMPLE 7

In this Example a copolymer of n-octadecene and maleic anhydride reacted with the diamine $R_2NH$ where R is a n $C_{16}$/n $C_{18}$ alkyl mixture (Copolymer S) was added to a distillate fuel F6 alone and with Copolymer Y (see Example 2) and comparisons were made with prior art copolymers also added to the same fuel by carrying out the tests PCT (at −10° C.) CFPPT and DSC.

The distillate fuel oil F6 to which the copolymers were added at concentrations of 175 and 300 ppm had the following ASTM D86 characteristics:

| | |
|---|---|
| IBP | 184° C. |
| D20 | 226° C. |
| D50 | 272° C. |
| D90 | 368° C. |
| FBP | 398° C. |

Comparisons were also made with other prior art copolymers BB and CC, details of which (including copolymer AA) are as follows:

Copolymer AA: a copolymer of octadecene and maleic anhydride.

Copolymer BB: copolymer AA reacted with hexadecanol to form the ester.

Copolymer CC: copolymer AA reacted with octadecanol to form the ester.

In the DSC (Differential Scanning Calorimetry) the Δ WAT (Wax Appearance Temperature) in °C. is measured this being the difference between the temperature at which wax appears for the base distillate fuel oil alone ($WAT_o$) and the temperature at which wax appears for the treated distillate fuel oil ($WAT_1$) when the calorimeter is cooled at 2° C./minute. In the DSC test results were obtained for only one concentration, namely, 300 ppm using 25 μl samples of fuel, i.e. $\Delta WAT = WAT_o - WAT_1$.

The results obtained were as follows where the first figure is for 175 ppm and the second figure (except DSC) for 300 ppm.

| | BB | CC | S |
|---|---|---|---|
| PCT alone | 60/60 | 30/30 | 150/250 |
| +Y* | 80/80 | 100/100 | 200/200 |
| CFPP alone | 0/Δ1 | 0/0 | Δ1/Δ1 |
| +Y* | Δ18/Δ19 | Δ15/Δ16 | Δ17/Δ20 |
| DSC ΔWAT | 4.2 | 2.8 | 2.2 |

When Y was present the mole ratio of Y to BB, CC or S is 4:1.

We claim:

1. A crude oil composition or a fuel oil composition comprising a major proportion by weight of a crude oil or a liquid hydrocarbon fuel and a minor porportion by weight of a polymer containing more than one amide group, the amide being an amide of a secondary mono amine and wherein the amide group of the polymer contains a hydrogen- and carbon-containing group of at least 14 carbon atoms, provided that if the polymer is derived from the polymerisation of an aliphatic olefin and maleic anhydride, the polymer must have both an amide group and an ester group each of which contains a hydrogen- and carbon-containing group of at least 14 carbon atoms.

2. A composition according to claim 1 wherein the fuel is a distillate fuel oil.

3. A composition according to claim 1 wherein the polymer is derived from a polymer of one or more unsaturated ester monomers also including a free acid group or from a copolymer of unsaturated ester monomers at least one of which has a free acid group.

4. A composition according to claim 1 wherein the polymer is derived from a copolymer of an unsaturated ester with an unsaturated carboxylic anhydride, an olefin with an unsaturated carboxylic anhydride, or mixtures thereof.

5. A composition according to claim 1 wherein the polymer is derived from a polymer of an unsaturated carboxylic acid.

6. A composition according to claim 1 wherein the polymer is derived from a partially hydrolysed polymer containing ester groups.

7. A composition according to claim 1 wherein the polymer is derived from a partially hydrolysed polymer of an unsaturated ester thereafter reacted with a carboxylic anhydride.

8. A composition according to claim 1 wherein the polymer is an N,N,N',N' tetrahydrocarbyl fumaradiamide polymer or an N,N,N',N' tetrahydrocarbylmaleadiamide polymer.

9. A composition according to claim 1 wherein the polymer is a polymer of N,N dihydrocarbyl acrylamide or of N,N dehydrocarbyl methacrylamide.

10. A composition according to claim 1 wherein amine from which the amide is derived has the formula $R^1R^2NH$ where $R^1$ and $R^2$ are hydrocarbyl groups containing at least 14 carbon atoms.

11. A composition according to claim 1 which also includes a polyoxyalkylene ester, ether, ester/ether or amide/ester, an ethylene-unsaturated ester copolymer flow improver or a polar nitrogen-containing compound or a mixture thereof.

12. A composition according to claim 11 wherein the polyoxyalkylene ester, ether, ester/ether or amide/ether contains at least two $C_{10}$ to $C_{30}$ linear saturated alkyl groups of a polyoxyalkylene glycol of molecular weight 100 to 5000.

13. A composition according to claim 1 wherein the amount of amide-containing polymer is 0.0001 to 5.0 wt % based on the weight of crude oil or hydrocarbon fuel.

14. The composition of claim 1 wherein the hydrogen- and carbon-containing group contains from 14 to 20 carbon atoms.

15. The composition of claim 1 wherein said polymer has a number average molecular weight of from 10,000 to 100,000.

16. A concentrate adapted for use as a wax crystal modifier to improve flow in crude oils or fuel oils comprising a solvent and 20 to 90 percent by weight, based on the weight of solvent, of a polymer containing more than one amide group, the amide being an amide of a secondary mono amine, and the amide group of the polymer contains a hydrogen- and carbon-containing group of at least 14 carbon atoms provided that if the polymer is derived from the polymerization of an aliphatic olefin and maleic anhydride, the polymer must have both an amide group and an ester group each of which contains a hydrogen- and carbon-containing group of at least 14 carbon atoms.

17. A concentrate according to claim 16 wherein the polymer is derived from a polymer of one or more unsaturated ester monomers also including a free acid group or from a copolymer of unsaturated ester monomers at least one of which has a free acid group.

18. A concentrate according to claim 16 wherein the polymer is derived from a copolymer of an unsaturated ester with an unsaturated carboxylic anhydride, an olefin with an unsaturated carboxylic anhydride, or mixtures thereof.

19. A concentrate according to claim 16 wherein the polymer is derived from a polymer of an unsaturated carboxylic acid.

20. A concentrate according to claim 16 wherein the polymer is derived from a partially hydrolysed polymer containing ester groups.

21. A concentrate according to claim 16 wherein the polymer is derived from a partially hydrolysed polymer of an unsaturated ester thereafter reacted with a carboxylic anhydride.

22. A concentrate according to claim 16 wherein the polymer is an N,N,N',N' tetrahydrocarbyl fumaradiamide polymer or an N,N,N',N' tetrahydrocarbylmaleadiamide polymer.

23. A concentrate according to claim 16 wherein the polymer is a polymer of N,N dihydrocarbyl acrylamide or of N,N dihydrocarbyl methacrylamide.

24. The concentrate of claim 16 wherein said hydrogen- and carbon-containing group contains from 14 to 20 carbon atoms.

25. The concentrate of claim 16 wherein said polymer has a number average molecular weight of from 10,000 to 100,000.

* * * * *